United States Patent [19]

Schmidt

[11] Patent Number: 4,493,099

[45] Date of Patent: Jan. 8, 1985

[54] FM BROADCASTING SYSTEM WITH TRANSMITTER IDENTIFICATION

[75] Inventor: Johan M. Schmidt, Eindhoven, Netherlands

[73] Assignee: U.S. Philips Corporation, New York, N.Y.

[21] Appl. No.: 340,165

[22] Filed: Jan. 18, 1982

[30] Foreign Application Priority Data

Jan. 29, 1981 [NL] Netherlands ..... 8100419

[51] Int. Cl.[3] ..... H04H 5/00

[52] U.S. Cl. ..... 381/14; 381/4; 370/76

[58] Field of Search ..... 179/1 GD, 1 GN; 370/69.1, 74, 76; 381/2, 3, 7, 10–14, 4, 8, 9

[56] References Cited

U.S. PATENT DOCUMENTS 4,246,440 1/1981 Van Der Heide et al. .... 179/1 GD
4,252,995 2/1981 Schmidt et al. ..... 179/1 GD

OTHER PUBLICATIONS

*Phillips Technical Review* 39, No. 8, "Station and Programme Identification in FM Sound Broadcasting", pp. 216–225, 1980, Gielas, Peek and Schmidt.

*Primary Examiner*—Gene Z. Rubinson
*Assistant Examiner*—W. J. Brady
*Attorney, Agent, or Firm*—Thomas A. Briody; William J. Streeter; Charles E. Quarton

[57] ABSTRACT

An FM broadcasting system comprises an FM transmitter for transmitting a multiplex signal which is frequency-modulated on a main carrier wave and an FM receiver for cooperation with said FM transmitter. The multiplex signal comprises: an audio-frequency first information signal and, in the case of a stereo transmission, a second information signal modulated on a suppressed stereo subcarrier, a stereo pilot signal whose frequency ($f_p$) is situated between the frequency spectra of the two information signals, a first binary-code signal ($f_p - f_c$) which is phase-modulated on a first code subcarrier situated outside the frequency spectra, which code subcarrier is a harmonic of a subharmonic of the stereo pilot ($f_p$) which harmonic does not coincide with a harmonic of said pilot ($f_p$), the multiplex signal, in order to extend the transmission capacity, comprising a second binary-code signal which is phase-modulated on a second code subcarrier ($f_p + f_c$). The carrier wave information of the two code subcarrier waves can be identified in a simple way by selecting their frequencies to be symmetrical about the stereo pilot signal or its harmonic ($3f_p$) and by selecting the phase angle between the sum of the two code subcarriers and the stereo pilot or the relevant harmonic thereof to be situated at preferably an integral multiple of $\pi/4$.

4 Claims, 4 Drawing Figures

FM BROADCASTING SYSTEM WITH TRANSMITTER IDENTIFICATION

Figure 1:
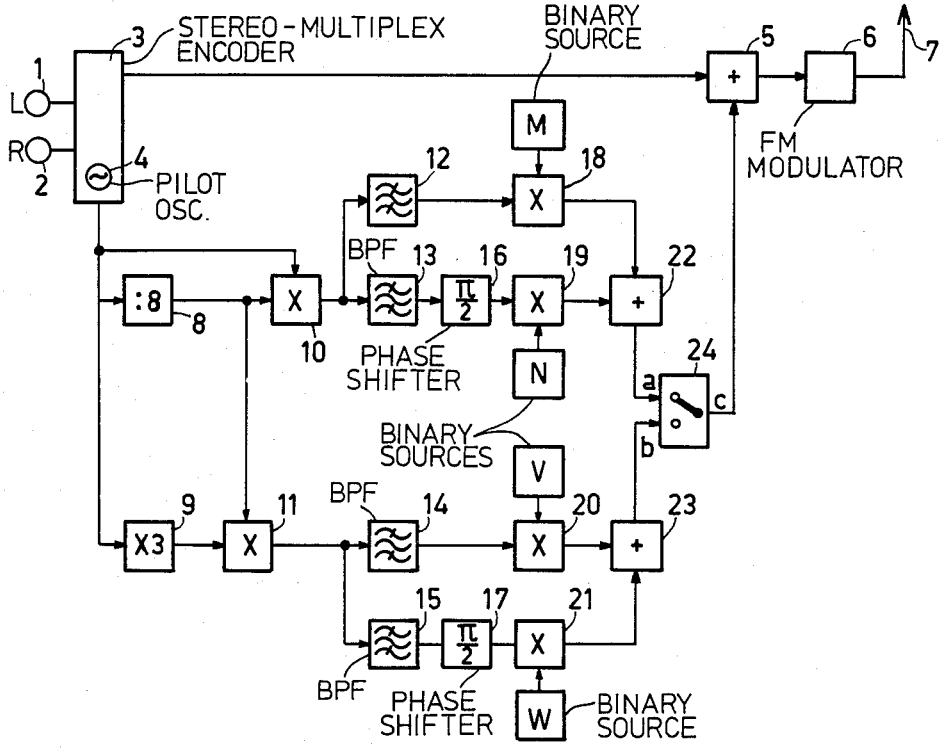

The invention relates to an FM-broadcasting system comprising an FM transmitter for transmitting a multiplex signal which is frequency-modulated on a main carrier wave and an FM receiver for cooperation with said FM transmitter, which multiplex signal comprises: an audio-frequency first information signal and, in the case of a stereo transmission, a second information signal modulated on a suppressed stereo subcarrier wave, a stereo pilot signal whose frequency is situated between the frequency spectra of the two information signals, and a first binary-code signal which is phase-modulated on a first code subcarrier wave situated outside said frequency spectra, said code subcarrier being a harmonic of a subharmonic of the stereo pilot, which harmonic does not coincide with a harmonic of said pilot.

The invention also relates to a transmitter for generating and transmitting signals, as used in such a system, and to a receiver for receiving and reproducing such signals.

Such an FM broadcasting system is known from Netherlands Patent Application No. 7800581 which has been laid open to public inspection. In this system the first binary code signal contains digitally coded information about inter alia the name and location of the transmitter, the designation and nature of the transmitted program, and the channel number.

In the known receivers of said FM broadcasting system the received first code subcarrier of the multiplex signal is demodulated to the base band in two steps.

Firstly, after selection from the multiplex signal at the output of the FM detector, the first code subcarrier is multiplied by the pilot signal, so as to obtain conversion to an auxiliary intermediate frequency. Said auxiliary IF then corresponds to the frequency difference between the pilot frequency and the frequency of the first code subcarrier. Subsequently, final frequency conversion to the base band is effected by means of a mixing signal regenerated from the pilot signal by frequency division and having a frequency of the order of magnitude of the auxiliary IF. The phase of the regenerated mixing signal is controlled in response to the phase of the frequency difference between the first code subcarrier and the pilot signal squared. In the prior art receiver the phase ambiguity which arises during final decoding of the received code signal as a result of squaring is eliminated by the use of a so-called differential code.

The transmission capacity of the first binary code signal is limited to approximately 600 bits/sec., owing to factors such as intersymbol interference and noise. The transmission capacity is insufficient to meet the growing demand for more information.

It is an object of the invention to provide an FM broadcasting system, having a greater information transmission capacity than the known FM broadcasting system without thereby degrading the signal separation between the signals in the multiplex signal and which enables a simple selection and demodulation of the transmitted binary information.

The invention provides, an FM broadcasting system as described in the opening paragraph is therefore characterized in that the multiplex signal further comprises at least a second binary bode signal, which is independent of the first binary code signal and which is binary phase-modulated on a second code subcarrier, which two code subcarriers have frequencies which are situated symmetrically about the stereo pilot signal frequency or an harmonic thereof, the resultant of the two code subcarriers being phase shifted relative to the stereo pilot signal or the relevant harmonic by an integral multiple of $\pi/4$.

When this step is used the second binary code signal provides additional transmission capacity of the same order of magnitude as that of the transmission capacity of the first binary code signal. It will be evident that in order to increase the transmission capacity of the multiplex signal it is in principle irrelevant which frequency and phase are selected for the second code subcarrier. This is because at the reception side the two code subcarriers can be recovered separately from the multiplex signal by means of two highly selective band-pass filters and are further processed in two separate parallel branches.

Said frequency and phase relationship between the two code subcarriers, however, enables the two code subcarriers to be recovered simultaneously from the multiplex signal, using only one simple band-pass filter and to be converted to the said auxiliary IF, whilst maintaining the possibility of separating the two code signals from each other.

The invention further provides an FM receiver for use in an FM broadcasting system as described hereinbefore characterized by a band-pass filter for selecting the two code subcarriers from the multiplex signal, which filter is arranged between an FM detector and signal inputs of first and second mixing stages, a pilot-oscillator circuit having first and second quadrature outputs, which are respectively connected to carrier-wave inputs of the first and second mixing stages, first and second low-pass filters, which are arranged between outputs of the two said mixing stages and inputs of a third mixing stage for selectively applying thereto the two code subcarriers which have been converted to an auxiliary intermediate frequency, a further band-pass filter which is arranged between the third mixing stage and a phase-control signal-generating circuit having a passband centered on a frequency which is twice said auxiliary intermediate frequency, and a frequency divider coupled to the pilot oscillator circuit, for generating a mixing signal with the auxiliary intermediate frequency, which divider is connected via a phase controller to a demodulation device for demodulating the two code subcarrier signals, which phase controller is connected to the phase-control signal-generating circuit for controlling the phase of the mixing signal relative to the output signal of the last-mentioned band-pass filter.

When this step is applied, after a first frequency conversion in the first and second mixing stages, the two code subcarriers have the same so-called auxiliary intermediate frequency equal to the frequency difference between the stereo pilot or the relevant harmonic thereof, and the two subcarriers, with a mutual 90° phase shift. This quadrature relationship of the two code subcarriers in the auxiliary IF ensures that the signal separation between the two code signals is maintained. Moreover, multiplying the two code subcarriers by each other in the third mixing stage provides a simple means of detecting their phase. An indication about the phase of the two code subcarriers is provided by the output signal of the third mixing stage, which is employed for controlling, in known manner, the phase of the mixing signal generated in the frequency divider.

A preferred embodiment of such an FM receiver in accordance with the invention is characterized in that the demodulation device comprises first and second synchronous demodulators each having first and second inputs, the first inputs of the two demodulators being connected to the said first and second low-pass filters respectively and the two inputs being connected to an output of the phase controller.

The invention further provides an FM transmitter for use in an FM broadcasting system as described hereinbefore is characterized in that a subcarrier generator is connected to a pilot oscillator, is adapted to supply first and second code subcarrier frequencies to two carrier, wave outputs, which are connected to two phase modulators in which the two code subcarriers are phase modulated with said first and second binary code signals, a frequency independent 90° phase shifter being arranged between one of the two carrier wave outputs and the phase modulator connected thereto.

The use of this transmitter enables a simple generation of the multiplex signal employed in the FM broadcasting system in accordance with the invention.

Figure 2A:
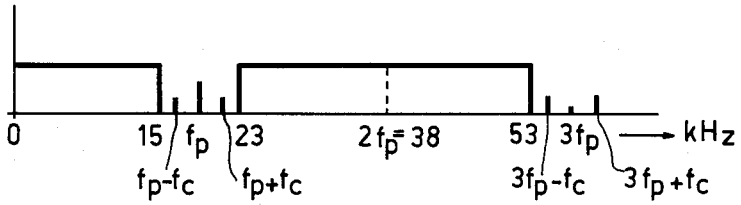
Figure 2B:
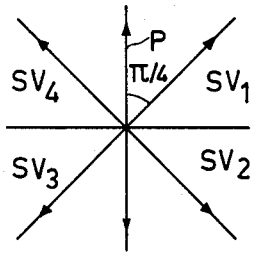
Figure 3:
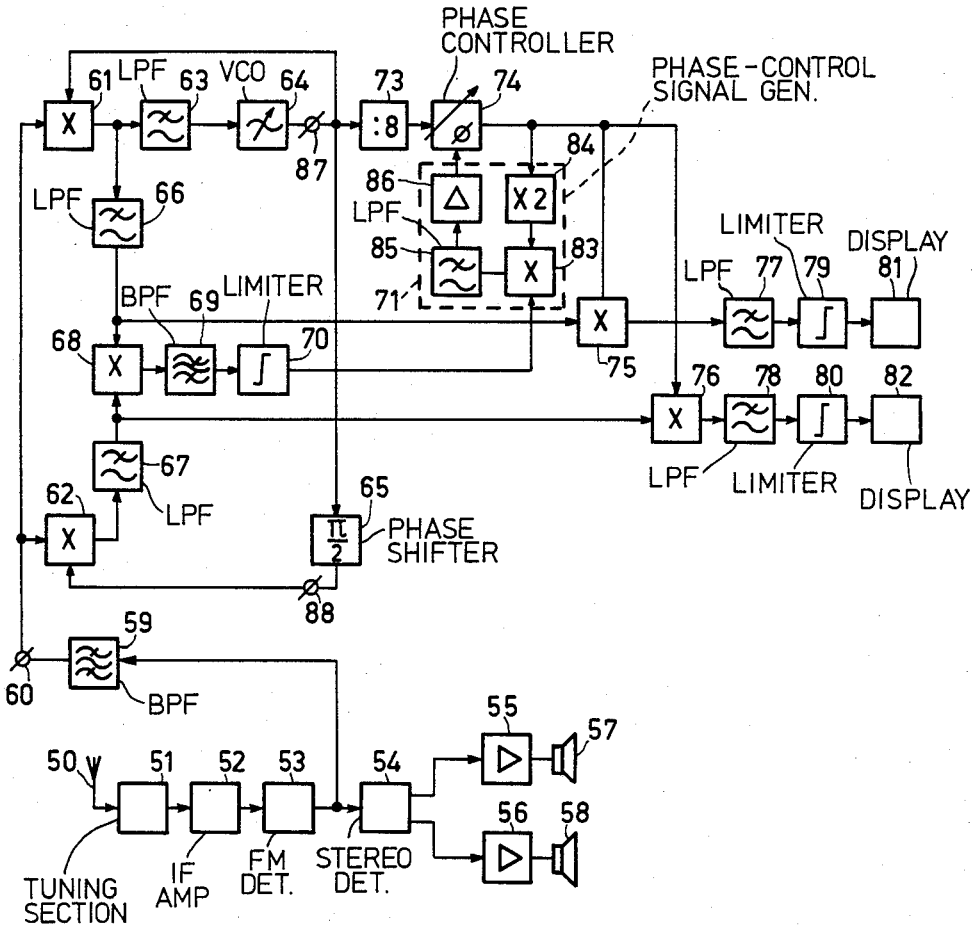

Embodiments of the invention will now be described by way of example with reference to the accompanying drawings, in which:

FIG. 1 is a block diagram of a transmitter adapted for use in two embodiments of the FM broadcasting system in accordance with the invention;

FIG. 2*a* shows the frequency spectrum of the multiplex signal in an FM broadcasting system in accordance with the invention, which multiplex signal is generated for frequency modulation at the transmitter side and is recovered after demodulation of the FM signal at the reception side;

FIG. 2*b* shows the vector diagram of the code subcarriers in the multiplex signal in a preferred embodiment of an FM broadcasting system in accordance with the invention;

FIG. 3 shows a block diagram of a first embodiment of an FM receiver for cooperation with an FM transmitter and an FM broadcasting system in accordance with the invention.

The transmitter shown in FIG. 1 comprises a source of left-hand audio signals 1 and a source of right-hand audio signals 2, which sources are connected to a stereo multiplex encoder 3. The stereo multiplex encoder 3 comprises a pilot oscillator 4 by means of which, in known manner, the left-hand and right-hand audio signals are processed to form a standard stereo multiplex signal, which contains the audio-frequency sum signal (L+R) of the left-hand and right-hand audio signals, the difference signal (L−R) modulated on a suppressed 38 kHz carrier wave, and the 19 kHz ($f_p$) pilot signal situated between the frequency spectra of the sum and difference signals. The frequency spectrum thereof of the pilot signal is represented in FIG. 2*a*.

An output of the stereo multiplex encoder 3 supplying said standard multiplex signal is coupled to an adder stage 5. The adder stage 5 is connected to an FM transmission modulator 6 and a transmission antenna 7.

The pilot oscillator 4 of the stereo multiplex encoder 3 is connected to a frequency dividing circuit 8 and to a frequency multiplying circuit 9, in which in known manner the pilot frequency $f_p$ is respectively divided by a factor 8 and multiplied by a factor 3. An output of the frequency dividing circuit 8 is coupled to first inputs of multiplier stages 10 and 11. A second input of the multiplier stage 10 is connected to the pilot oscillator 4. The multiplier stage 10 consequently supplies output signals at inter alia $f_p-f_c$ and $f_p+f_c$, where $f_p=19$ kHz and $f_c=\frac{1}{8}f_p$. These output signals serve as first and second code subcarrier waves, on which first and second binary code signals m(t) and n(t) are phase-modulated, as will be described hereinafter.

A second input of the multiplier stage 11 is connected to an output of the frequency multiplying circuit 9. The multiplier stage 11 consequently supplies output signals at inter alia $3f_p-f_c$ and $3f_p+f_c$, which may serve as code subcarriers for two further binary code signals.

Via a band-pass filter 12 having passband centred on a resonant frequency $f_p-f_c$ the multiplier stage 10 is connected to a carrier-wave input of a modulator 18 and via a band-pass filter 13 having a resonant frequency $f_p+f_c$ and a frequency-independent 90° phase shifter 16 to a carrier-wave input of a modulator 19. Thus, the modulators 18 and 19 receive first and second code subcarriers respectively which may be represented by the expressions: cos $(w_p-w_c)t$ and sin $(w_p+w_c)t$, where $w_p=2\pi f_p$ and $w_c=2\pi\cdot\frac{1}{8}f_p$.

The circuits 8, 10, 12 and 13 consequently function as a subcarrier generator for supplying the first and second code subcarrier frequencies to the modulators 18 and 19 respectively.

The modulators 18 and 19 are respectively coupled to binary signal sources M and N, which supply the first and the second binary code signals m(t) and n(t) respectively, with which the first and second code subcarriers are binary phase-modulated in order to obtain signals which may be represented by the expressions m(t) cos $(w_p-w_c)t$ and n(t) sin $(w_p+w_c)t$, where $|m(t)|=1$ and $|n(t)|=1$. The outputs of the modulators 18 and 19 are connected to a switching contact a of a switch 24 via an adder stage 22, in which the two modulated code subcarriers are added to each other. A master contact c of the switch 24 is connected to the adder stage 5, in which the two modulated code subcarriers are added to the standard multiplex signal in position (a) of the switch 24.

In a similar way the multiplier stage 11 is connected to a carrier-wave input of a modulator 20 via a band-pass filter 14 having a passband centred on the resonant frequency $3f_p-f_c$ and to a carrier-wave input of a modulator 21 via band-pass filter 15 having a pass-band centred on the frequency $3f_p+f_c$ and a frequency-independent 90° phase shifter. Thus the modulators 20 and 21 receive further code subcarriers which may be represented by the expressions cos $(3w_p-w_c)t$ and sin $(3w_p+w_c)$ t. The circuits 9, 11, 14 and 15 thus function as a subcarrier generator for supplying said further code subcarriers. The modulators 20 and 21 are respectively connected to binary signal sources V and W, which supply further binary code signals v(t) and w(t), with which the two further code subcarriers are binary phase-modulated on $3f_p-f_c$ and $3f_p+f_c$ respectively, to form signals which may be represented by the expressions v(t) cos $(3w-w_c)t$ and w(t) sin $(3w_p+w_c)t$, where $|v(t)|=1$ and $|w(t)|=1$. The outputs of the modulators 20 and 21 are connected to a switching contact b of the switch 24 via an adder stage 23, in which the two last-mentioned modulated code subcarriers are added to each other. In position (b) of the switch 24 said further code subcarriers are added to the standard multiplex signal.

The operation and construction of the said circuits are known per se from Netherlands Patent Application No. 7800581, which has been laid open to public inspection and need no further explanation in order to understand the present invention.

It will be evident that the block diagram of FIG. 1 relates to an experimental transmitter, which is suitable for testing which system provides the best practical performance. In the final version the transmitter need only be adapted for the use of one system and may therefore be of simple construction. For the final choice it may therefore be considered to use the version in which 4 binary code signals are transmitted, which can be achieved in the transmitter of FIG. 1 by connecting the outputs of the modulators 18–21 directly to the adder stage 5. The frequency spectrum of the multiplex signal thus obtained is represented in FIG. *2a*.

The vector sum of these two code carriers in position (a) of the switch 24: $m(t) \cos (w_p - w_c)t + n(t) \sin (w_p + w_c)t$ relative to the pilot signal $\cos w_p t$ is represented by $SV_1$–$SV_4$ in FIG. *2b* for the four possible combinations of m(t) and n(t) values. Here, the pilot signal is represented by a vector P. The phase angle between the pilot vector P and each of the vectors $SV_1$–$SV_4$ is then an integral multiple of $\pi/4$.

The vector sum of the further modulated code subcarriers in position (b) of the switch 24: $v(t) \cos (3w_p - w_c)t + w(t) \sin (3wp - w_c)t$ may, similarly to the proceding case, also be represented by the vectors $SV_1$–$SV_4$, the third harmonic of the pilot signal $\cos 3w_p t$ now being represented by the vector P. The phase relationship between the last-menntioned sum of the two further code subcarriers and the third harmonic of the pilot is the same as that between the sum of the first and second code subcarriers and the pilot.

FIG. 3 represents the block diagram of an FM receiver in accordance with the invention adapted for cooperation with the FM transmitter of FIG. 1 in position (a) of the switch 24. Said FM receiver comprises, connected to an antenna device 50, a tuning section 51, an IF amplifier 52, an FM detector 53, in this order. On the output of the FM detector 53 the multiplex signal is available, which in addition to said standard multiplex signal comprises the said first and second modulated code subcarriers. The standard stereo multiplex signal, in the case of a stereo transmission, is applied to the stereo decoder 54, which supplies left-hand and right-hand audio signals, which via audio amplifiers 55 and 56 are applied to the left-hand and right-hand loudspeakers 57 and 58.

The two modulated code subcarriers $m(t) \cos (w_p - w_c)t + n(t) \sin (w_p + w_c)t$ and the 19-kHz stereo pilot $\cos w_p t$, whose frequency is situated therebetween, are filtered out of the multiplex signal by means of a band-pass filter 59 having a passband centred on the frequency $f_p$ and having a bandwidth $2f_c$ and applied to signal inputs of first and second mixing stages 61 and 62 via a code input 60.

The mixing stage 61 forms part of a phase-locked loop, which includes a voltage controlled oscillator (VCO) 64. The output of the mixing stage 61 is connected to a control input of the VCO 64 via a low pass filter 63 and an output of the VCO 64 is connected to a carrier-wave input of the mixing stage 61. The phase-locked loop 61, 63, 64 is tuned to the stereo pilot $f_p$ in known manner, so that in the locked condition the VCO 64 functions as a pilot oscillator circuit, which on a first quadrature output 87 produces a signal $\cos w_c t$, whose frequency and phase are locked by those of the transmitted stereo pilot. The VCO 64 is also connected to a second quadrature output 88 of said pilot oscillator circuit via a frequency-independent 90° phase shifter 65. The quadrature output 88 is connected to a carrier wave input of the second mixing stage 62. Outputs of the mixing stages 61 and 62 are connected to inputs of a third mixing stage 68 via low-pass filters 66 and 67 respectively for applying thereto signals having an auxiliary intermediate frequency $f_c$:

$$m(t) \cos w_c t + n(t) \sin w_c(t), \quad (1)$$

and $$m(t) \sin w_c t + n(t) \cos w_c(t). \quad (2)$$

On an output of the third mixing stage 68 this results in a signal of twice the auxiliary intermediate frequency $2f_c$, namely: $\sin 2w_c t + m(t)n(t)$. After filtering by a band-pass filter 69, which is connected to the last-mentioned output, the signal $\sin 2w_c t$ is derived from said signal. The band-pass filter 69 is connected to a first input of a phase-control signal generating circuit 71 via a limiter 70.

The phase-control signal generating circuit 71 controls a phase controller 74, which is coupled to an output of a frequency divider 73. The frequency divider 73 is connected to the VCO 64 and devides the pilot frequency $f_p$ regenerated in the VCO 64 by a factor 8, yielding a mixing signal $\cos (w_c t + \phi)$. The phase ambiguity owing to frequency division is reduced to a two phase uncertainly in the phase controller 74, in known manner. For this purpose, the output signal of the phase controller 74 is frequency-doubled in a frequency doubler 84 and is then multiplied by the output signal of the limiter 70 in a multiplier stage 83 which functions as a phase detector. An output of the multiplier stage 83 is connected to a control input of the phase controller 74 via a low-pass filter 85 and an amplifier 86 in order to supply a control signal to the phase controller 74 when phase difference between the two signals applied to the multiplier stage 83 exists. Thus, the mixing signal $\cos w_c t$ is obtained on the output of the phase controller 74.

An output of the phase controller 74 is connected to the carrier wave inputs of fourth and fifth mixing stages 75 and 76, which function as synchronous demodulation devices. Signal inputs of the fourth and fifth mixing stages 75 and 76 are respectively connected to outputs of the low-pass filters 66 and 67. In the fourth and fifth mixing stages 75 and 76 the mixing signal $\cos w_c t$ is multiplied by $m(t) \cos w_c t + n(t) \sin w_c t$ and by $m(t) \sin w_c t + n(t) \cos w_c t$ respectively. Outputs of the fourth and fifth mixing stages 75 and 76 are respectively connected to low-pass filters 77, 78 which respectively select the desired first and second code signals m(t) and n(t) from the mixing products on the outputs of the fourth and fifth mixing stages 75 and 76.

Said binary code signals m(t) and n(t) are applied to limiters 79, 80 and control units/display devices 81, 82, in which the first and second binary code signals are converted, in known manner, into optical characters.

Said circuits are known per se from the publication "The SPI-system for FM-tuning" published by N. V. Philips' Gloeilampenfabrieken, Electronic Components and Materials Division in 1978. A further description of these circuits is not necessary for understanding the present invention and is therefore omitted.

Obviously there are several possibilities to demodulate the code signals from the auxiliary intermediate frequency $f_c$ to the baseband. In the case of a multiplication of, for example, the signal $m(t) \cos w_c t + n(t) \sin w_c t$ on the output of the low-pass filter 66 by the mixing signal cos $w_c t$, the first binary code signal m(t) is obtained after filtering and in the case of multiplication by the mixing signal sin $w_c t$, which is 90° phase-shifted, the second binary code signal n(t) is obtained. Such a demodulation is obtained by connecting the signal input of the fifth mixing stage 76 to the low-pass filter 66 and by connecting the carrier wave input of said mixing stage 76 to the phase controller 74 via a 90° phase-shifter, not shown.

A similar demodulation can be obtained by multiplying the signal m(t) sin $w_c t + n(t) \cos w_c t$ at the output of the low-pass filter 67 by the mixing signal cos $w_c t$ and by the 90° phase-shifted mixing signal sin $w_c t$ in order to obtain the second and the first binary code signal m(t) and n(t) respectively.

It is also conceivable, utilizing the invention, to first regenerate the frequency of the two code subcarriers by a multiplication, not represented, of the pilot signal $f_p$ on the output of the VCO 64 by the regenerated mixing signal $f_c$ on the output of the phase controller 74, followed by a frequency selection with the aid of band-pass filters having passbands centred on the resonant frequencies $f_p + f_c$ and $f_p - f_c$. With the regenerated first and second code subcarrier frequencies, which are thus separately available, it is subsequently possible through separate multiplication by the signal on the code input 60 and by filtering, to demodulate the code signals m(t) and n(t) directly from the customary FM intermediate frequency.

For processing transmitter signals produced in position (b) of the switch 24 of the transmitter of FIG. 1 the two code signals v(t) cos $(3w_p - w_c)t + w(t)$ sin $(3w_p + w_c)t$ and the pilot signal cos $w_p t$ should be available on the code input 60.

Regeneration of the pilot signal and subsequently of the mixing signal cos $w_c t$ is effected in the same way as in the preceding case.

Demodulation of the last-mentioned code subcarriers to the auxiliary intermediate frequency $f_c$ can be achieved by multiplying the frequency of the regenerated pilot $f_p$ on the output of the VCO 64 by a factor 3 and applying the resultant signal cos $3w_p t$ to a carrier-wave input of a mixing stage, not shown, of which a signal input is connected to the code input 60 and of which a signal output is connected to the first low-pass filter 66, and applying said resultant signal to the second mixing stage 62 via the frequency-independent 90° phase-shifter 65.

Further demodulation of the two further code signals v(t) and w(t) from the auxiliary intermediate frequency to the baseband may be effected in the same way as described in the foregoing case for the first and second code signals m(t) and n(t).

What is claimed is:

1. An FM transmitter for an FM-broadcasting system for transmitting a multiplex signal which is frequency modulated on a main carrier wave comprising means for generating an audio-frequency first information signal and, in the case of a stereo transmission, a second information signal modulated on a suppressed stereo subcarrier wave, means for generating a stereo pilot signal whose frequency is situated between the frequency spectra of the two information signals, means for generating a first binary code signal which is phase-modulated on a first code subcarrier situated outside said frequency spectra, said code subcarrier being a harmonic of a subharmonic of the stereo pilot, which harmonic does not coincide with a harmonic of said pilot, characterized in that the transmitter further comprises means for generating at least a second binary code signal, which is independent of the first binary code signal and which is binary phase-modulated on a second code subcarrier, which two code subcarriers have frequencies which are situated symmetrically about the stereo pilot signal frequency or a harmonic thereof, the two resultants of the two code subcarriers being separated in phase by 90° and the two resultants of the subcarriers each being separated in phase from the stereo pilot signal by an odd integer multiple of $\pi/4$.

2. An FM transmitter for an FM broadcasting system as claimed in claim 1, characterized by a subcarrier generator, connected to a pilot oscillator, said subcarrier generator supplying first and second code subcarrier frequencies to two carrier-wave outputs, said outputs being connected to two phase modulators for the binary phase modulation of the two code subcarriers with said first and second binary code signals, a frequency independent 90° phase-shifter being arranged between one of the two carrier-wave outputs and the phase modulator connected thereto.

3. An FM receiver for a broadcast system having a stereo multiplex signal, a stereo pilot signal, a first and second binary code signal transmitted on a first and second subcarrier, respectively, said first and second code subcarriers having frequencies which are located about the stereo pilot signal frequency or a harmonic thereof, the resultants of the first and second code subcarriers being separated in phase by 90° and the resultants of the two code subcarriers each being separated in phase from the stereo pilot signal by an odd integer multiple of $\pi/4$, characterized by a first band-pass filter for selecting the two code subcarriers from the multiplex signal, which filter is arranged between an FM detector and signal inputs of first and second mixing stages, a pilot-oscillator circuit having first and second quadrature outputs, which are respectively connected to carrier-wave inputs of the first and second mixing stages, first and second low-pass filters, which are arranged between outputs of said mixing stages and inputs of a third mixing stage for selectively applying thereto the two code subcarriers which have been converted to an auxiliary intermediate frequency, a second band-pass filter arranged between the third mixing stage and a phase-control signal generating circuit and having a passband center on a resonant frequency which is twice said auxiliary intermediate frequency, and by a frequency divider coupled to the pilot oscillator circuit, for generating a mixing signal with the auxiliary intermediate frequency, which divider, via a phase controller, is connected to a demodulation device for demodulating the two code subcarrier signals, which phase controller is connected to the phase-control signal generating circuit for controlling the phase of the mixing signal relative to the output signal of the second band-pass filter.

4. An FM receiver as claimed in claim 3, characterized in that said demodulation device comprises first and second synchronous demodulators each having first and second inputs, the first inputs of the two demodulators respectively being connected to the said first and second low-pass filters and the second inputs being connected to an output of the phase controller.

* * * * *